US005378571A

United States Patent [19]

Macholdt et al.

[11] Patent Number: 5,378,571

[45] Date of Patent: Jan. 3, 1995

[54] ARYL AND ARALKYL SULFIDE, SULFOXIDE OR SULFONE COMPOUNDS AS CHARGE REGULATORS

[75] Inventors: Hans-Tobias Macholdt, Darmstadt; Gert Nagl, Niederdorfelden, both of Germany

[73] Assignee: Hoechst Aktiengesellschaft, Frankfurt am Main, Germany

[21] Appl. No.: 39,021

[22] PCT Filed: Oct. 1, 1991

[86] PCT No.: PCT/EP91/01873

§ 371 Date: Apr. 2, 1993

§ 102(e) Date: Apr. 2, 1993

[87] PCT Pub. No.: WO92/06414

PCT Pub. Date: Apr. 16, 1992

[30] Foreign Application Priority Data

Oct. 6, 1990 [DE] Germany ..... 4031705

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,377,629 | 3/1983 | Tarumi et al. | 430/62 |
| 4,480,021 | 10/1984 | Lu et al. | 430/106.6 |
| 4,795,690 | 1/1989 | Shindo et al. | 430/110 X |
| 5,238,768 | 8/1993 | Ong | 430/110 |
| 5,250,381 | 10/1993 | Ciccarelli et al. | 430/110 X |

FOREIGN PATENT DOCUMENTS

| | | | |
|---|---|---|---|
| 0201340 | 12/1986 | European Pat. Off. . | |
| 0359123 | 3/1990 | European Pat. Off. . | |
| 0393503 | 10/1990 | European Pat. Off. . | |
| 3149 | 1/1986 | Japan | 430/110 |
| 266462 | 11/1988 | Japan | 430/110 |

*Primary Examiner*—Roland Martin

*Attorney, Agent, or Firm*—Connolly & Hutz

[57] ABSTRACT

Aryl and aralkyl sulfide, sulfoxide or sulfone compounds as charge regulators

Use of aryl sulfide, sulfoxide or sulfone compounds (sic) of the structural type

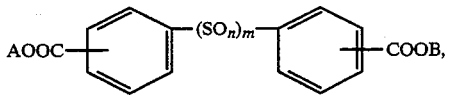

where m is 1, 2 or 3 and n is 0, 1 or 2 and A and B are a hydrogen or metal ion, an ammonium, immonium or guanidinium ion or a phosphonium, arsonium or stilbonium ion, as charge regulators for electrophotographic toners, developers, powders and powder coatings.

Use of aryl sulfide, sulfoxide or sulfone compounds having the structural type (I), in which m=1, 2 or 3, n=0, 1 or 2 and A and B represent a hydrogen or metal ion, an ammonium, immonium or guanidinium ion or a phosphonium, arsonium or stilbonium ion, as charge regulators for electrophotographic toners, developers, powders or powder coatings.

8 Claims, No Drawings

ARYL AND ARALKYL SULFIDE, SULFOXIDE OR SULFONE COMPOUNDS AS CHARGE REGULATORS

DESCRIPTION

The present invention relates to the use of special aryl and aralkyl sulfide, sulfoxide or sulfone compounds as charge regulators in electrophotographic toners and developers and as charge regulators in powders and powder coatings for surface coating. The compounds according to the invention have particularly high and constant charge regulating effects and are distinguished by the simplicity of the synthesis units and the preparation process. In addition, these compounds have very good thermal stabilities and dispersing properties.

In electrophotographic recording processes a "latent charge image" is produced on a photoconductor. This is effected, for example by charging a photoconductor by means of a corona discharge and subsequent image-wise exposure of the electrostatically charged surface of the photoconductor, drainage of the charge to the earthed substrate at the exposed areas being effected by the exposure. The "latent charge image" produced in this way is then developed by applying a toner. In a subsequent step, the toner is transferred from the photoconductor to, for example, paper, textiles, foils or plastic and fixed, for example by means of pressure, radiation, heat or solvent action. The photoconductor used is then cleaned and is available for a fresh recording operation.

The optimization of toners is described in numerous patents and, inter alia, the influence of the toner binder (variation of resin/resin components or wax/wax components), the influence of carriers (in the case of two-component developers) and magnetic pigments (in the case of one-component developers) are studied.

A criterion for the toner quality is its specific charge q/m (charge per unit mass). In addition to the sign and level of the electrostatic charge, in particular the rapid achievement of the desired charge level and the constancy of said charge over a prolonged activation period is a decisive quality criterion. In practice, this is of central importance inasmuch as the toner can be exposed to a considerable activation time in the developer mixture before it is transferred to the photoconductor since it sometimes remains in the developer mixture over a period extending from the preparation up to several thousand copies. In addition, the insensitivity of the toner to climatic influences, such as temperature and atmospheric humidity, is a further important suitability criterion.

Both positively and negatively chargeable toners are used in copiers and laser printers, depending on the process and equipment type.

So-called charge regulators (also termed charge controllers) are frequently added in order to obtain electrophotographic toners or developers which have either positive or negative charging. In addition to the sign of the charge regulation, the extent of the regulating effect is important since a greater effectiveness permits the use of a smaller amount. Since toner binders as a rule show high dependence of the charge on the activating time, the purpose of a charge regulator is, on the one hand, to adjust the sign and level of the toner charge and, on the other hand, to counteract the charging drift of the toner binder and to ensure constancy of toner charging.

Charge regulators which are not able to prevent the toner or developer exhibiting a high charge drift when used over a prolonged period (ageing), which can even cause the toner or developer to undergo charge reversal, are therefore unsuitable in practice. Full-color copiers and laser printers operate on the principle of trichromatism, which makes precise color shade matching of the three primary colors (yellow, cyan and magenta) necessary.

Extremely small shifts in color shade, even in only one of the three primary colors, necessarily demands a shift in color shade of the other two colors to enable full-color copies or prints true to the original to be produced even under these conditions.

Because of this requisite precise matching of the coloristics of the individual colorants with respect to one another in color toners, charge regulators which have absolutely no inherent color are very particularly important.

In color toners the three toners yellow, cyan and magenta, must be matched not only to the precisely defined color requirements but must also be precisely matched to one another in respect of their triboelectric properties. This triboelectric matching is required because the three color toners (or four color toners if black is included) have to be transferred in the same apparatus in the case of full color printing or in the case of full color copying.

It is known that colorants can adversely affect the triboelectric charging of toners (H. -T. Macholdt, A. Sieber, Dyes & Pigments 9 (1988), 119–27; U.S. Pat. No. 4,057,426). Because of the different triboelectric effect of colorants and the resulting influence on the toner chargeability, which is very pronounced in some cases, it is not possible simply to add them as colorants to a toner base formulation which has already been made up. On the contrary, it may be necessary to make up an individual formulation for each colorant, for which, for example, the type and amount of the required charge regulator are specially tailored. This procedure is correspondingly costly and in the case of color toners for process color (trichromatism) is in addition to the difficulties already described.

Highly effective, colorless charge regulators are therefore required which are capable of compensating for the different triboelectric characteristics of different colorants and of imparting the desired charge to the toner. In this way it is possible, with the aid of a toner base formulation which has already been prepared, to use triboelectrically very different colorants with one and the same charge regulator in the diverse requisite toners (yellow, cyan, magenta and, where appropriate, black). In addition, for practical applications it is important that the charge regulators have high thermal stability and good dispersibility. Typical temperatures for incorporation of charge regulators in the toner resins are between 100° C. and 200° C. when using, for example, kneaders or extruders. Accordingly, a thermal stability of >200° C., and preferably of >250° C. is of great advantage. It is also important that the thermal stability is ensured over a prolonged period (about 30 min) and in diverse binder systems. This is significant since recurring matrix effects lead to premature decomposition of the charge regulator in the toner resin, as a result of which a dark yellow or dark brown discoloration of the toner resin takes place and the charge regulating effect is completely or partially lost. Typical toner binders are polymerization, polyaddition and polycondensation resins, such as, for example, styrene, styrene acrylate, styrene-butadiene, acrylate, polyester, phenolic and epoxy resins, on their own or in combination, which can contain yet further constituents, such as colorants, waxes or flow assistants, or can have said further constituents added at a later time.

For good dispersibility it is highly advantageous if the charge regulator as far as possible has no waxy characteristics, no tackiness and a melting or softening point of >150° C., preferably >200° C. Tackiness frequently leads to problems when metering into the toner formulation and low melting or softening points could lead to a homogeneous distribution not being achieved on dispersion, since the material agglomerates, for example in droplet form, in the carrier material.

As well as in electrophotographic toners and developers, charge regulators can also be used to improve the electrostatic charging of powders and coatings, in particular in triboelectrically or electrokinetically sprayed powder coatings, such as are used for surface coating of articles made of, for example, metal, wood, plastic, glass, ceramic, concrete, textile material, paper or rubber. Powder coating technology is used, inter alia, in coating small articles, such as garden furniture, camping articles, domestic equipment, vehicle components, refrigerators and shelving and when coating workpieces of complex shape. The powder coating or the powder generally acquires its electrostatic charge by one of the two following processes:

a) in the corona process the powder coating or the powder is passed by a charged corona and thus charged, and
b) in the triboelectric or electrokinetic process use is made of the principle of frictional electricity. The powder coating or the powder acquires in a spray apparatus an electrostatic charge opposite to the charge of the frictional partner, in general a hose or spray tube (for example composed of polytetrafluoroethylene). A combination of the two processes is also possible. The powder coating resins used are typically epoxy resins, carboxyl and hydroxyl group-containing polyester resins, acrylic resins and polyurethanes together with the corresponding curing agents. Combinations of resins are also used.

Thus, for example, epoxy resins are frequently used in combination with carboxyl and hydroxyl group-containing polyester resins. Typical curing components for epoxy resins are, for example, acid anhydrides, imidazoles and dicyandiamide and derivatives thereof. Typical curing agent components for hydroxyl group-containing polyester resins are, for example, acid anhydrides, blocked isocyanates, bisacylurethanes, phenolic resins and melamine resins and typical curing agent components for carboxyl group-containing polyester resins are, for example, triglycidyl isocyanurates or epoxy resins. Typical curing agent components used in acrylic resins are, for example, oxazolines, isocyanates, triglycidyl isocyanurates or dicarboxylic acids.

The lack of inadequate charging can be observed, in particular, in the case of triboelectrically or electrokinetically sprayed powders and powder coatings which have been prepared on the basis of polyester resins, in particular carboxyl group-containing polyesters, or on the basis of so-called mixed powders, which are also termed hybrid powders. Mixed powders are understood to be powder coatings in which the base resin comprises a combination of epoxy resin and carboxyl group-containing polyester resin. The mixed powders form the basis for the powder coatings most frequently used in practice.

Inadequate charging of the abovementioned powders and powder coatings leads to an inadequate deposition rate and wrap-round on the workpiece to be coated. (The term "wrap-round" is a measure for the extent to which a powder or powder coating also deposits on backs, cavities and crevices and in particular on inside edges and inside corners of the workpiece to be coated.) Colorless charge regulators are claimed in numerous patents. Thus, for example, DE-A 3144017, JP-A 61-236557 and U.S. Pat. No. 4,656,112 describe metal complexes and organometallic compounds, DE-A 3837345, DE-A 3738948, DE-A 3604827, EP-A 242420, EP-A 203532, U.S. Pat. No. 4,684,596, U.S. Pat. No. 4,683,188 and U.S. Pat. No. 4,493,883 describe ammonium and immonium compounds and DE-A 3912396, U.S. Pat. No. 4,496,643 and U.S. Pat. No. 3,893,935 phosphonium compounds and European Patent 185509, JP-A 01-136166, JP-A 63-060458, JP-A 62-264066, U.S. Pat. No. 4,840,863, U.S. Pat. No. 4,639,043, U.S. Pat. No. 4,378,419, U.S. Pat. No. 4,355,167 and U.S. Pat. No. 4,299,898 describe polymer ammonium compounds as colorless charge regulators for electrophotographic toners.

However, the colorless charge regulators disclosed hitherto have a number of disadvantages which severely restrict the use in practice and in some cases make this impossible. Thus, the chromium, iron, cobalt and zinc complexes described in DE-A 3144017 and U.S. Pat. No. 4,656,112 and the antimony organyls described in JP-A 61-236557 also have the disadvantage, in addition to the problems associated with heavy metals, that some of these compounds are not truly colorless and thus can find only restricted use in color toners.

The known quaternary ammonium and phosphonium compounds, which are suitable per se, are frequently difficult to disperse, which leads to non-uniform charging of the toner. In addition, the problem frequently arises that the toner charge generated by these compounds is not stable over a prolonged activation period (an activation time of up to 24 hours), in particular at high temperature and atmospheric humidity (EP-A 242420), which in the course of a copying or printing process then leads to enrichment of incorrectly or inadequately charged toner particles and thus causes the process to come to a standstill. It has also been disclosed that ammonium- and immonium-based charge regulators can be sensitive to light or mechanical effects (EP-A 203532, U.S. Pat. No. 4,683,188) and can be thermally labile, and that they form decomposition products which can have an adverse effect on the triboelectric charging of the toner (U.S. Pat. No. 4,684,596) and/or have a strong, frequently dark brown inherent color (DE-A 3738948, DE-A 3604827, U.S. Pat. No. 4,493,883). In addition, they frequently display waxy behavior and some of them are soluble in water and/or have little effectiveness as charge regulators.

Charge regulators based on ammonium, immonium and phosphonium compounds fluorinated to a high degree (DE-A 3912396, DE-A 3837345, which are suitable per se, have the disadvantage of a laborious synthesis, as a result of which production costs for the corresponding substances are high. In addition, they do not have adequate stability to heat.

Phosphonium salts are less effective as charge regulators than ammonium salts (U.S. Pat. No. 4,496,643, U.S. Pat. No. 3,893,939) and can present toxicological problems. Some charge regulators based on polymer ammonium compounds lead to the toner or developer having an amine odor, and the charge regulating properties of these substances can change by relatively easy oxidation and absorption of moisture. Furthermore, the oxidation products are colored and therefore interfering, in particular in color toners (U.S. Pat. No. 4,840,863). Since they are colored, the abovementioned charge regulators for electrophotographic toners and developers are, for example, not suitable for use in the predominantly white or clear triboelectrically or electrokinetically sprayed powders and powder coatings. In addition, the lack of stability to heat severely restricts the use of such charge regulators, since powder coatings are, for example, baked for 15 minutes at above 200° C. The charge regulators for powders and powder coatings claimed in DE-A 3837345 and DE-A 3600395 are difficult to handle and have only restricted application because they are waxy and soluble in water or hygroscopic. The amines claimed in European Patent 0371528, on the other hand, are not very suitable for use in practice because of their odor nuisance.

The object of the present invention was, therefore, to find novel colorless charge regulators which possess high and constant charge regulating effects and are distinguished by very good stabilities to heat and dispersing properties. In addition, it should be possible to synthesize said charge regulators from inexpensive, readily available precursors by simple preparation processes.

Surprisingly, it has now been found that compounds of the general formula (1)

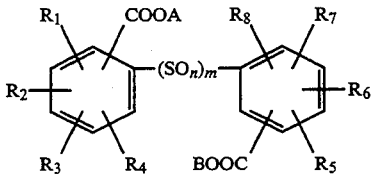

(1)

on their own or in combination, are suitable as charge regulators for electrophotographic toners and developers and for coatings and powder coatings, where, in formula (1), m is 1, 2 or 3, preferably 1 or 2, and n is 0, 1 or 2, n is preferably 0 when m is 2 or 3 and n is preferably 1 or 2 when m is 1, and where A and B independently of one another are hydrogen atoms, the corresponding equivalents of a metal ion, preferably of a calcium, magnesium, barium, aluminum, chromium, manganese, iron, cobalt, nickel, copper or zinc ion, and also an ammonium or immonium or guanidinium ion of the general formula

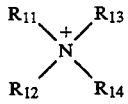

(2)

or

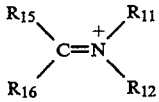

(3)

or phosphonium, arsonium or stibonium ions of the general formula (4)

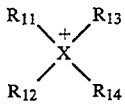

(4)

where X is P, As or Sb, preferably P, in which $R_{11}$, $R_{12}$, $R_{13}$ and $R_{14}$ independently of one another are hydrogen atoms or a radical based on a hydrocarbon which can be interrupted by hetero-atoms, such as, for example, straight-chain or branched alkyl groups of 1 to 30 carbon atoms, preferably of 1 to 22 carbon atoms, oxyethyl groups of the general formula $-(CH_2-CH_2-O)_n-R$ in which R is a hydrogen atom or a $C_1$–$C_4$-alkyl group or an acryl group, such as, for example, the acetyl, benzoyl or naphthoyl group, and n is a number from 1 to 10, preferably from 1 to 4, and also mononuclear or polynuclear cyclopentyl groups, mononuclear or polynuclear aromatic radicals, such as, for example, phenyl, 1-naphthyl, 2-naphthyl, tolyl or bisphenyl radicals, or araliphatic radicals, such as, for example, the benzyl radical, it being possible for the aliphatic, araliphatic and aromatic radicals to be substituted by hydroxyl, $C_1$–$C_4$-alkyl or $C_1$–$C_4$-alkoxy groups, primary, secondary or tertiary amino groups, such as, for example, N-mono($C_1$–$C_4$)alkylamino or N-di($C_1$–$C_4$)-alkylamino groups, and also acid amide groups, preferably phthalimide or naphthalimide groups, as well as by by (sic) fluorine, chlorine or bromine atoms and it being possible for the aliphatic radicals in particular to be substituted by 1 to 33 fluorine atoms, and $R_{15}$ and $R_{16}$ independently of one another are a hydrogen atom, a halogen atom, preferably chlorine, or radicals based on a hydrocarbon, such as, for example, $C_1$–$C_6$-alkyl or $C_1$–$C_6$-alkoxy groups, which can be interrupted by heteroatoms, or an amino group of the general formula $-NR_{17}R_{18}$ in which $R_{17}$ and $R_{18}$ independently of one another are hydrogen atoms or radicals based on a hydrocarbon, preferably $C_1$–$C_6$-alkyl groups, it being possible for $R_{11}$ and $R_{13}$, or $R_{11}$ and $R_{15}$ to join to form a saturated or unsaturated, substituted or unsubstituted ring system having 5 to 7 atoms, which can contain further heteroatoms, preferably nitrogen atoms and/or oxygen atoms and/or sulfur atoms (examples of such ring systems which may be mentioned are phenylene, naphthylene, pyridine, piperidine and derivatives thereof) and it being possible for the two carboxyl or carboxylate groups —COOA and —COOB to be located at any desired position in the particular aromatic ring, but preferably in the 2,2′ or 3,3′ or 4,4′ position relative to one another, and in which $R_1$ to $R_8$ independently of one another are hydrogen atoms or radicals based on a hydrocarbon, which can be interrupted by heteroatoms, such as, for example, a straight-chain or branched, saturated or unsaturated alkyl group having 1 to 30 carbon atoms, preferably having 1 to 22 carbon atoms, and also $C_1$–$C_4$-alkoxylene groups, polyoxalkylene groups of the general formula —[($C_1$–$C_5$)alkylene-O]n—R, in which R is a hydrogen atom or a $C_1$–$C_4$-alkyl group or an acyl group, such as, for example, an acetyl, benzoyl or naphthoyl group, and n is a number from 1 to 10, preferably from 1 to 4, and also mononuclear or polynuclear cycloaliphatic radicals of 5 to 12 carbon atoms, such as, for example, a cyclopentyl or cyclohexyl radical, mononuclear or polynuclear aromatic radicals, such as, for example, phenyl, naphthyl, tolyl or biphenyl radicals, or an araliphatic radical, such as, for example, the benzyl radical, it being possible for the said aliphatic, cycloaliphatic, araliphatic or aromatic radicals to be substituted by carboxylic acid or sulfonic acid groups, the salts or amides or esters thereof, $C_1$–$C_4$-alkyl, hydroxyl or $C_1$–$C_4$-alkoxy groups, primary, secondary or tertiary amino groups, such as, for example, N-mono($C_1$–$C_4$)alkylamino or N-di($C_1$–$C_4$)alkylamino groups, and also by fluorine, chlorine or bromine atoms, it being possible for the aliphatic radicals preferably to be substituted by 1 to 45 fluorine atoms, and it being possible for the said aliphatic radicals and also the cycloaliphatic, araliphatic or aromatic ring systems to contain one or more heteroatoms, such as, for example, nitrogen and/or oxygen and/or sulfur and/or phosphorus atoms, and it being possible for two of the radicals $R_1$to $R_4$, or $R_5$ to $R_8$, to join together independently of one another to form a saturated or unsaturated, preferably aromatic, 5-membered to 7-membered ring system, which can contain further heteroatoms, preferably nitrogen and/or oxygen and/or sulfur atoms, and to be substituted and/or modified by addition by condensation or by bridging to give further ring systems, and in which $R_1$ to $R_8$ independently of one another can also be fluorine, chlorine, bromine or iodine atoms or a nitro, cyano, sulfone, sulfonic acid ester, carboxylic acid ester, hydroxyl or —$NR_{21}R_{22}$ group, in which $R_{21}$ and $R_{22}$ independently of one another are a hydrogen atoms (sic) or $C_1$–$C_4$-alkyl groups, and it being possible for the compounds also to be in the form of mixed crystals based on different anions and/or cations. Examples of individual compounds which may be mentioned are:

2,2-dithiodibenzoic acid ("2,2'-DTDB")
mono-[tetramethylammonium]-2,2'-dithiodibenzoic acid
di-[tetramethylammonium]-2,2'-dithiodibenzoic acid
mono-[tetraethylammonium]-2,2'-dithiodibenzoic acid
di-[tetraethylammonium]-2,2'-dithiodibenzoic acid
mono-[tetrapropylammonium]-2,2'-dithiodibenzoic acid
di-[tetrapropylammonium]-2,2'-dithiodibenzoic acid
mono-[tetrabutylammonium]-2,2'-dithiodibenzoic acid
di-[tetrabutylammonium]-2,2'-dithiodibenzoic acid
mono-[tetrapentylammonium]-2,2'-dithiodibenzoic acid
di-[tetrapentylammonium]-2,2'-dithiodibenzoic acid
mono-[tetrahexylammonium]-2,2'-dithiodibenzoic acid
di-[tetrahexylammonium]-2,2'-dithiodibenzoic acid
mono-[tetraheptylammonium]-2,2'-dithiodibenzoic acid
di-[tetraheptylammonium]-2,2'-dithiodibenzoic acid
mono-[tetraoctylammonium]-2,2'-dithiodibenzoic acid
di-[tetraoctylammonium]-2,2'-dithiodibenzoic acid
mono-[trimethylbenzylammonium]-2,2'-dithiodibenzoic acid
di-[trimethylbenzylammonium]-2,2'-dithiodibenzoic acid
mono-[tributylmethylammonium]-2,2'-dithiodibenzoic acid
di-[tributylmethylammonium]-2,2'-dithiodibenzoic acid
mono-[tributylmethylammonium]-2,2'-dithiodibenzoic acid
di-[tributylmethylammonium]-2,2'-dithiodibenzoic acid
mono-[ethylhexadecyldimethylammonium]-2,2'-dithiodibenzoic acid
di-[ethylhexadecyldimethylammonium]-2,2'-dithiodibenzoic acid
mono-[benzyldimethylhexadecylammonium]-2,2'-dithiodibenzoic acid
di-[benzyldimethylhexadecylammonium]-2,2'-dithiodibenzoic acid
mono-[benzyltriethylammonium]-2,2'-dithiodibenzoic acid
di-[benzyltriethylammonium]-2,2'-dithiodibenzoic acid
mono-[hexadecyltrimethylammonium]-2,2'-dithiodibenzoic acid
di-[hexadecyltrimethylammonium]-2,2'-dithiodibenzoic acid
mono-[hexadecylpyridinium]-2,2'-dithiodibenzoic acid
di-[hexadecylpyridinium]-2,2'-dithiodibenzoic acid
mono-[cetylpyridinium]-2,2'-dithiodibenzoic acid
di-[cetylpyridinium]-2,2'-dithiodibenzoic acid
mono-[phenyltrimethylammonium]-2,2'-dithiodibenzoic acid
di-[phenyltrimethylammonium]-2,2'-dithiodibenzoic acid
mono-[benzyltriphenylphosphonium]-2,2'-dithiodibenzoic acid
di-[benzyltriphenylphosphonium]-2,2'-dithiodibenzoic acid
mono-[tetrabutylphosphonium]-2,2'-dithiodibenzoic acid
di-[tetrabutylphosphonium]-2,2'-dithiodibenzoic acid
mono-[guanidinium]-2,2'-dithiodibenzoic acid
di-[guanidinium]-2,2'-dithiodibenzoic acid
barium 2,2'-dithiodibenzoate
calcium 2,2'-dithiodibenzoate
magnesium 2,2'-dithiodibenzoate
manganese 2,2'-dithiodibenzoate
nickel 2,2'-dithiodibenzoate
cobalt 2,2'-dithiodibenzoate
copper 2,2'-dithiodibenzoate
iron 2,2'-dithiodibenzoate
zinc 2,2'-dithiodibenzoate
di-aluminum tri-2,2'-dithiodibenzoate
di-chromium tri-2,2'-dithiodibenzoate
di-iron tri-2,2'-dithiodibenzoate
tin di-2,2'-dithiobenzoate
4,4'-dithiodibenzoic acid (4,4'-DTDB)
mono-[tetramethylammonium]-4,4'-dithiodibenzoic acid
di-[tetramethylammonium]-4,4'-dithiodibenzoic acid
mono-[tetraethylammonium]-4,4'-dithiodibenzoic acid
di-[tetraethylammonium]-4,4'-dithiodibenzoic acid
mono-[tetrapropylammonium]-4,4'-dithiodibenzoic acid
di-[tetrapropylammonium]-4,4'-dithiodibenzoic acid
mono-[tetrabutylammonium]-4,4'-dithiodibenzoic acid
di-[tetrabutylammonium]-4,4'-dithiodibenzoic acid
mono-[trimethylbenzylammonium]-4,4'-dithiodibenzoic acid
di-[trimethylbenzylammonium]-4,4'-dithiodibenzoic acid
mono-[tributylmethylammonium]-4,4'-dithiodibenzoic acid
di-[tributylmethylammonium]-4,4'-dithiodibenzoic acid
mono-[ethylhexadecyldimethylammonium]-4,4'-dithiodibenzoic acid
di-[ethylhexadecyldimethylammonium]-4,4'-dithiodibenzoic acid
mono-[benzyldimethylhexadecylammonium]-4,4'-dithiodibenzoic acid
di-[benzyldimethylhexadecylammonium]-4,4'-dithiodibenzoic acid
mono-[benzyltriethylammonium]-4,4'-dithiodibenzoic acid di-[benzyltriethylammonium]-4,4'-dithiodibenzoic acid
mono-[hexadecyltrimethylammonium]-4,4'-dithiodibenzoic acid
di-[hexadecyltrimethylammonium]-4,4'-dithiodibenzoic acid
mono-[hexadecylpyridinium]-4,4'-dithiodibenzoic acid
di-[hexadecylpyridinium]-4,4'-dithiodibenzoic acid
mono-[cetylpyridinium]-4,4'-dithiodibenzoic acid
di-[cetylpyridinium]-4,4'-dithiodibenzoic acid
mono-[phenyltrimethylammonium]-4,4'-dithiodibenzoic acid
di-[phenyltrimethylammonium]-4,4'-dithiodibenzoic acid
mono-[benzyltriphenylphosphonium-4,4'-dithiodibenzoic acid
di-[benzyltriphenylphosphonium-4,4'-dithiodibenzoic acid
mono-[tetrabutylphosphonium]-4,4'-dithiodibenzoic acid
di-[tetrabutylphosphonium]-4,4'-dithiodibenzoic acid
barium 4,4'-dithiodibenzoate
calcium 4,4'-dithiodibenzoate
magnesium 4,4'-dithiodibenzoate
manganese 4,4'-dithiodibenzoate
nickel 4,4'-dithiodibenzoate
cobalt 4,4'-dithiodibenzoate
copper 4,4'-dithiodibenzoate
iron 4,4'-dithiodibenzoate
zinc 4,4'-dithiodibenzoate
di-aluminum tri-4,4'-dithiodibenzoate
di-chromium tri-4,4'-dithiodibenzoate
di-iron tri-4,4'-dithiodibenzoate
tin di-4,4'-dithiobenzoate
2,2'-sulfonyldibenzoic acid
2,2'-sulfonyldibenzoic acid
mono-[tetramethylammonium]-2,2'-sulfonyldibenzoic acid
di-[tetramethylammonium]-2,2'-sulfonyldibenzoic acid
mono-[tetraethylammonium]-2,2'-sulfonyldibenzoic acid
di-[tetraethylammonium]-2,2'-sulfonyldibenzoic acid
mono-[tetrapropylammonium]-2,2'-sulfonyldibenzoic acid
di-[tetrapropylammonium]-2,2'-sulfonyldibenzoic acid
mono-[tetrabutylammonium]-2,2'-sulfonyldibenzoic acid
di-[tetrabutylammonium]-2,2'-sulfonyldibenzoic acid
mono-[trimethylbenzylammonium]-2,2'-sulfonyldibenzoic acid
di-[trimethylbenzylammonium]-2,2'-sulfonyldibenzoic acid
mono-[tributylmethylammonium]-2,2'-sulfonyldibenzoic acid
di-[tributylmethylammonium]-2,2'-sulfonyldibenzoic acid
mono-[ethylhexadecyldimethylammonium]-2,2'-sulfonyldibenzoic acid
di-[ethylhexadecyldimethylammonium]-2,2'-sulfonyldibenzoic acid
mono-[benzyldimethylhexadecylammonium]-2,2'-sulfonyldibenzoic acid
di-[benzyldimethylhexadecylammonium]-2,2'-sulfonyldibenzoic acid
mono-[benzyltriethylammonium]-2,2'-sulfonyldibenzoic acid
di-[benzyltriethylammonium]-2,2'-sulfonyldibenzoic acid
mono-[hexadecyltrimethylammonium]-2,2'-sulfonyldibenzoic acid
di-[hexadecyltrimethylammonium]-2,2'-sulfonyldibenzoic acid
mono-[hexadecylpyridinium]-2,2'-sulfonyldibenzoic acid
di-[hexadecylpyridinium]-2,2'-sulfonyldibenzoic acid
mono-[cetylpyridinium]-2,2'-sulfonyldibenzoic acid
di-[cetylpyridinium]-2,2'-sulfonyldibenzoic acid
mono-[phenyltrimethylammonium]-2,2'-sulfonyldibenzoic acid
di-[phenyltrimethylammonium]-2,2'-sulfonyldibenzoic acid
mono-[benzyltriphenylphosphonium]-2,2'-sulfonyldibenzoic acid
di-[benzyltriphenylphosphonium]-2,2'-sulfonyldibenzoic acid
mono-[tetrabutylphosphonium]-2,2'-sulfonyldibenzoic acid
di-[tetrabutylphosphonium]-2,2'-sulfonyldibenzoic acid
barium 2,2'-sulfonyldibenzoic acid (sic)
calcium 2,2'-sulfonyldibenzoic acid (sic)
magnesium 2,2'-sulfonyldibenzoic acid (sic)
manganese 2,2'-sulfonyldibenzoic acid (sic)
nickel 2,2 '-sulfonyldibenzoic acid (sic)
cobalt 2,2'-sulfonyldibenzoic acid (sic)
copper 2,2'-sulfonyldibenzoic acid (sic)
iron 2,2'-sulfonyldibenzoate
zinc 2,2'-sulfonyldibenzoate
di-aluminum tri-2,2'-sulfonyldibenzoate
di-chromium tri-2,2'-sulfonyldibenzoate
di-iron tri-2,2'-sulfonyldibenzoate
tin di-2,2'-sulfonyldibenzoate
4,4'-sulfonyldibenzoic acid
mono-[tetramethylammonium]-4,4'-sulfonyldibenzoic acid
di-[tetramethylammonium]-4,4'-sulfonyldibenzoic acid
mono-[tetraethylammonium]-4,4'-sulfonyldibenzoic acid
di-[tetraethylammonium]-4,4'-sulfonyldibenzoic acid
mono-[tetrapropylammonium]-4,4'-sulfonyldibenzoic acid
di-[tetrapropylammonium]-4,4'-sulfonyldibenzoic acid
mono-[tetrabutylammonium]-4,4'-sulfonyldibenzoic acid
di-[tetrabutylammonium]-4,4'-sulfonyldibenzoic acid
mono-[trimethylbenzylammonium]-4,4'-sulfonyldibenzoic acid
di-[trimethylbenzylammonium]-4,4'-sulfonyldibenzoic acid
mono-[tributylmethylammonium]-4,4'-sulfonyldibenzoic acid
di-[tributylmethylammonium]-4,4'-sulfonyldibenzoic acid
mono-[ethylhexadecyldimethylammonium]-4,4'-sulfonyldibenzoic acid
di-[ethylhexadecyldimethylammonium]-4,4'-sulfonyldibenzoic acid
mono-[benzyldimethylhexadecylammonium]-4,4'-sulfonyldibenzoic acid
di-[benzyldimethylhexadecylammonium]-4,4'-sulfonyldibenzoic acid
mono-[benzyltriethylammonium]-4,4'-sulfonyldibenzoic acid
di-[benzyltriethylammonium]-4,4'-sulfonyldibenzoic acid
mono-[hexadecyltrimethylammonium]-4,4'-sulfonyldibenzoic acid di-[hexadecyltrimethylammonium]-4,4'-sulfonyldibenzoic acid
mono-[hexadecylpyridinium]-4,4'-sulfonyldibenzoic acid
di-[hexadecylpyridinium]-4,4'-sulfonyldibenzoic acid
mono-[cetylpyridinium]-4,4'-sulfonyldibenzoic acid
di-[cetylpyridinium]-4,4'-sulfonyldibenzoic acid
mono-[phenyltrimethylammonium]-4,4'-sulfonyldibenzoic acid
di-[phenyltrimethylammonium]-4,4'-sulfonyldibenzoic acid
mono-[benzyltriphenylphosphonium]-4,4'-sulfonyldibenzoic acid
di-[benzyltriphenylphosphonium]-4,4'-sulfonyldibenzoic acid
mono-[tetrabutylphosphonium]-4,4'-sulfonyldibenzoic acid
di-[tetrabutylphosphonium]-4,4'-sulfonyldibenzoic acid
barium 4,4'-sulfonyldibenzoate
calcium 4,4'-sulfonyldibenzoate
magnesium 4,4'-sulfonyldibenzoate
manganese 4,4'-sulfonyldibenzoate
nickel 4,4'-sulfonyldibenzoate
cobalt 4,4'-sulfonyldibenzoate
copper 4,4'-sulfonyldibenzoate
iron 4,4'-sulfonyldibenzoate
zinc 4,4'-sulfonyldibenzoate
di-aluminum tri-4,4-sulfonyldibenzoate
di-chromium tri-4,4-sulfonyldibenzoate
di-iron tri-4,4-sulfonyldibenzoate
tin di-4,4-sulfonyldibenzoate
2,2'-sulfinyldibenzoic acid
mono-[tetramethylammonium]-2,2'-sulfinyldibenzoic acid
di-[tetramethylammonium]-2,2'-sulfinyldibenzoic acid
mono-[tetraethylammonium]-2,2'-sulfinyldibenzoic acid
di-[tetraethylammonium]-2,2'-sulfinyldibenzoic acid
mono-[tetrapropylammonium]-2,2'-sulfinyldibenzoic acid
di-[tetrapropylammonium]-2,2'-sulfinyldibenzoic acid
mono-[tetrabutylammonium]-2,2'-sulfinyldibenzoic acid
di-[tetrabutylammonium]-2,2'-sulfinyldibenzoic acid
mono-[trimethylbenzylammonium]-2,2'-sulfinyldibenzoic acid
di-[trimethylbenzylammonium]-2,2'-sulfinyldibenzoic acid
mono-[tributylmethylammonium]-2,2'-sulfinyldibenzoic acid
di-[tributylmethylammonium]-2,2'-sulfinyldibenzoic acid
mono-[ethylhexadecyldimethylammonium]-2,2'-sulfinyldibenzoic acid
di-[ethylhexadecyldimethylammonium]-2,2'-sulfinyldibenzoic acid
mono-[benzyldimethylhexadecylammonium]-2,2'-sulfinyldibenzoic acid
di-[benzyldimethylhexadecylammonium]-2,2'-sulfinyldibenzoic acid
mono-[benzyltriethylammonium]-2,2'-sulfinyldibenzoic acid
di-[benzyltriethylammonium]-2,2'-sulfinyldibenzoic acid
mono-[hexadecyltrimethylammonium]-2,2'-sulfinyldibenzoic acid
di-[hexadecyltrimethylammonium]-2,2'-sulfinyldibenzoic acid
mono-[hexadecylpyridinium]-2,2'-sulfinyldibenzoic acid
di-[hexadecylpyridinium]-2,2'-sulfinyldibenzoic acid
mono-[cetylpyridinium]-2,2'-sulfinyldibenzoic acid
di-[cetylpyridinium]-2,2'-sulfinyldibenzoic acid
mono-[phenyltrimethylammonium]-2,2'-sulfinyldibenzoic acid
di-[phenyltrimethylammonium]-2,2'-sulfinyldibenzoic acid
mono-[benzyltriphenylphosphonium]-2,2'-sulfinyldibenzoic acid
di-[benzyltriphenylphosphonium]-2,2'-sulfinyldibenzoic acid
mono-[tetrabutylphosphonium]-2,2'-sulfinyldibenzoic acid
di-[tetrabutylphosphonium]-2,2'-sulfinyldibenzoic acid
barium 2,2'-sulfinyldibenzoate
calcium 2,2'-sulfinyldibenzoate
magnesium 2,2'-sulfinyldibenzoate
manganese 2,2'-sulfinyldibenzoate
nickel 2,2'-sulfinyldibenzoate
cobalt 2,2'-sulfinyldibenzoate
copper 2,2'-sulfinyldibenzoate
iron 2,2'-sulfinyldibenzoate
zinc 2,2'-sulfinyldibenzoate
di-aluminum tri-2,2'-sulfinyldibenzoate
di-chromium tri-2,2'-sulfinyldibenzoate
di-iron tri-2,2'-sulfinyldibenzoate
tin di-2,2'-sulfinyldibenzoate
4,4'-sulfinyldibenzoic acid
mono-[tetramethylammonium]-4,4'-sulfinyldibenzoic acid
di-[tetramethylammonium]-4,4'-sulfinyldibenzoic acid
mono-[tetraethylammonium]-4,4'-sulfinyldibenzoic acid
di-[tetraethylammonium]-4,4'-sulfinyldibenzoic acid
mono-[tetrapropylammonium]-4,4'-sulfinyldibenzoic acid
di-[tetrapropylammonium]-4,4'-sulfinyldibenzoic acid
mono-[tetrabutylammonium]-4,4'-sulfinyldibenzoic acid
di-[tetrabutylammonium]-4,4'-sulfinyldibenzoic acid
mono-[trimethylbenzylammonium]-4,4'-sulfinyldibenzoic acid
di-[trimethylbenzylammonium]-4,4'-sulfinyldibenzoic acid
mono-[tributylmethylammonium]-4,4'-sulfinyldibenzoic acid
di-[tributylmethylammonium]-4,4'-sulfinyldibenzoic acid
mono-[ethylhexadecyldimethylammonium]-4,4'-sulfinyldibenzoic acid
di-[ethylhexadecyldimethylammonium]-4,4'-sulfinyldibenzoic acid
mono-[benzyldimethylhexadecylammonium]-4,4'-sulfinyldibenzoic acid
di-[benzyldimethylhexadecylammonium]-4,4'-sulfinyldibenzoic acid
mono-[benzyltriethylammonium]-4,4'-sulfinyldibenzoic acid
di-[benzyltriethylammonium]-4,4'-sulfinyldibenzoic acid
mono-[hexadecyltrimethylammonium]-4,4'-sulfinyldibenzoic acid
di-[hexadecyltrimethylammonium]-4,4'-sulfinyldibenzoic acid
mono-[hexadecylpyridinium]-4,4'-sulfinyldibenzoic acid
di-[hexadecylpyridinium]-4,4'-sulfinyldibenzoic acid mono-[cetylpyridinium]-4,4'-sulfinyldibenzoic acid
di-[cetylpyridinium]-4,4'-sulfinyldibenzoic acid
mono-[phenyltrimethylammonium]-4,4'-sulfinyldibenzoic acid
di-[phenyltrimethylammonium]-4,4'-sulfinyldibenzoic acid
mono-[benzyltriphenylphosphonium]-4,4'-sulfinyldibenzoic acid
di-[benzyltriphenylphosphonium]-4,4'-sulfinyldibenzoic acid
mono-[tetrabutylphosphonium]-4,4'-sulfinyldibenzoic acid
di-[tetrabutylphosphonium]-4,4'-sulfinyldibenzoic acid
barium 4,4'-sulfinyldibenzoate
calcium 4,4'-sulfinyldibenzoate
magnesium 4,4'-sulfinyldibenzoate
manganese 4,4'-sulfinyldibenzoate
nickel 4,4'-sulfinyldibenzoate
cobalt 4,4'-sulfinyldibenzoate
copper 4,4'-sulfinyldibenzoate
iron 4,4'-sulfinyldibenzoate
zinc 4,4'-sulfinyldibenzoate
di-aluminum tri-4,4'-sulfinyldibenzoate
di-chromium tri-4,4'-sulfinyldibenzoate
di-iron tri-4,4'-sulfinyldibenzoate
tin di-4,4'-sulfinyldibenzoate.

As well as in toners and developers and in coatings and powder coatings, the compounds claimed according to the invention can also be used as charge-improving agents in the form of coatings on carriers, or as a constituent of coatings on carriers, which are used in developers for electrophotographic copiers or printers. In the case of the diacids of the general formula (1) where A=B=H, the preparation of the compounds claimed according to the invention is disclosed in the literature, for example 2,2'-dithiodibenzoic acid: Org. Synth., Coll. Vol. II 580, (1943); 3,3'-dithiobenzoic acid: J. pharm. Soc. Japan 77, 965, 968 (1957); 4,4'-dithiobenzoic acid: J. Heterocyclic Chem. 17, 497 (1980); 2,2'-thiodibenzoic acid: Berichte der deutschen chemischen Gesellschaft 43, 588 (1910); 4,4'-thiodibenzoic acid: J. pharm. Soc. Japan 64, 186, 189 (1944); 2,2-sulfinyldibenzoic acid: J. American Chem. Soc. 75, 280 (1953); 4,4'-sulfinyldibenzoic acid: U.S. Pat. No. 3,504,022; 2,2'-sulfonyldibenzoic acid: J. American Chem. Soc. 75, 280 (1953); and 4,4'-sulfonyldibenzoic acid: Acta Chem. Scandinavia 7(5), 778 (1953). The synthesis of the mono- and di-salts claimed according to the invention can be carried out, for example, by a neutralization or precipitation reaction using the corresponding hydroxides, hydrogen carbonates, carbonates, halides and other salts, as described in the examples.

The particular advantage of the compounds claimed according to the invention is that they are colorless and very stable to heat and have a high charge regulating effect and that said effect is constant over a prolonged activation period (up to 24 hours). Thus, for example, a test toner containing 1% by weight of the monotetrapropylammonium salt of 2,2'-dithiodibenzoic acid (2,2'-DTDB) shows a charge of +11 μC/g after 10 min, of +12 uC/g after 30 min, of +10 uC/g after 2 hours and of +7 μC/g after 24 hours. In addition, the charge regulating effect is also not susceptible to changes in atmospheric humidity from 50% to 20% or to 90% (Example 5). The high charge regulating fact becomes even clearer if, for example, the charge characteristics of the pure toner binder "Dialec S-309" is considered for comparison (Comparison Example: −4 μC/g after 10 min, −12 uC/g after 30 min, −27 uC/g after 2 hours and −48 uC/g after 24 hours).

In the same way, the compounds claimed according to the invention also have a charge-regulating effect in powders and powder coatings for surface coatings. A test powder coating in the polyester resin Crylcoat 430 containing 1 percent by weight of the monotetrabutylammoniumsalt of 2,2'-DTDB or containing 1 percent by weight of the said 2,2'-DTDB salt and 30 percent by weight of Tiona RCL 628 ($TiO_2$ from SCM, England) shows a charge of −7 and, respectively, −6 μC/g after 10 min, of −6 and, respectively, −6 μC/g after 30 min, of −5 and, respectively, −5 μC/g after 2 hours and of −4 and, respectively, −4 μC/g after 24 hours' activation time (Example 18 and Example 17 respectively), compared with which the pure powder coating resin Crylcoat 430 without further additives has a charge of −20 μC/g after 10 min, −15 μC/g after 30 min, −8 μC/g after 2 hours and −4 μC/g after 24 hours.

The fact that the compounds claimed according to the invention are chemically inert and readily compatible with binders, such as, for example, styrene acrylates, polyesters, epoxides and polyurethanes, is of great importance for practical applications. In addition, the compounds can be incorporated into the conventional binders without difficulty using the conventional processes (extruding, kneading) under the customary conditions (temperatures of between 100° C. and 200° C.). The synthesis of the compounds claimed according to the invention is not very laborious and the products are obtained in high purity.

The compounds used according to the invention are as a rule homogeneously incorporated in a concentration of from about 0.01 to about 30 percent by weight, preferably of from about 0.1 to about 5.0 percent by weight, into the particular binder in a known manner, for example by extrusion or kneading in. The charge regulators for toners or charge-improving agents for powders and coatings for surface coatings, in particular for triboelectrically or electrokinetically sprayed powder coatings, can be added in the form of dried and ground powders, dispersions or solutions, a pressed cake or a masterbatch, in the form of compounds absorbed from aqueous or nonaqueous solution on suitable carriers, such as, for example, silica gel, $TiO_2$ or $Al_2O_3$, or in some other form. In principle, the compounds used according to the invention can also already be added during the preparation of the particular binder, ie. in the course of the polymerization, polyaddition or polycondensation thereof. The level of the electrophotographic toners or of the powder coatings in which the charge regulators claimed according to the invention have been homogeneously incorporated was measured on standard test systems under identical conditions (such as identical dispersing times, identical particle size distribution and identical particle shape) at room temperature and 50% relative atmospheric humidity.

Electrostatic charging of the toner or powder coating was effected by swirling with a carrier, i.e. a standardized frictional partner (3 parts by weight of toner or powder per 97 parts by weight of carrier) on a rolling bench (150 revolutions per minute). The electrostatic charge was then measured on a conventional q/m measuring stage (cf. J. H. Dessauer, H. E. Clark, "Xerography and related Processes", Focal Press, N.Y., 1965, page 289 and J. F. Hughes, "Electrostatic Powder Coating", Research Studies Press Ltd., Letchworth, Hertfordshire, England, 1984, Chapter 2). The particle size has a substantial influence in the determination of the q/m value and it is for this reason that strict attention was paid to uniform particle size distribution [4–25 μm] in the toner and powder coating samples obtained by screening.

The following examples serve to illustrate the invention, without restricting it thereto. The indicated parts are parts by weight.

USE EXAMPLES

Example 1

One part of the monotetramethylammonium salt of 2,2'-dithiobenzoic acid (=2,2'-DTDB) (see below for synthesis and characterization of the compound) were homogeneously dispersed into 99 parts of toner binder (®Dialec S 309 from Diamond Shamrock (styrene-methacrylic copolymer)) using a kneader from Werner and Pfleiderer (Stuttgart) for 30 minutes. The dispersion was then ground on a 100 LU laboratory universal mill (Alpine, Augsburg) and then classified on the 100 MZR centrifugal separator.

The desired particle fraction was activated with a carrier composed of magnetized particles 50 to 200 μm in size coated with 90:10 styrene-methacrylic copolymer, of the type "90 μm Xerographic Carrier" from Plasma Materials Inc.

Measurement is carried out on a conventional q/m measuring stage (cf. in this context J. H. Dessauer, H. E. Clark "xerography and related Processes", Focal Press, N.Y. 1965, page 289); using a sieve having a mesh width of 25 μm (508 mesh per inch) from Febrüder Kufferath, Düren, it was ensured that no carrier can be entrained when the toner is blown off. The measurements were carried out at room temperature and 50% relative atmospheric humidity; deviating test conditions are noted in the relevant examples. The following q/m values [μC/g] were measured, depending on the activation time:

| Activation time | [μC/g] |
|---|---|
| 10 min | +4 |
| 30 min | +4 |
| 2 hours | +3 |
| 24 hours | +2 |

Synthesis and Characterization 30.6 g of 2,2'-dithiodibenzoic acid (0.10 mol) are suspended in 600 ml of ethanol. 36.5 g of a 25% strength aqueous tetramethylammonium hydroxide solution (0.10 mol) are added slowly dropwise to this suspension, with stirring, at 70°–75° C. A moist crystal mass precipitates out of the reaction solution on concentrating and is dried in a circulating air oven at 120° C. and then ground.

Yield: 37.8 g (99.6% of theory) Mono-(tetramethylammonium) salt of 2,2'-dithiodibenzoic acid, of the formula

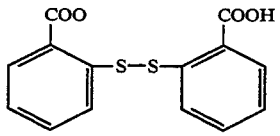

Tetramethylammonium $C_{18}H_{21}NO_4SO_2$, molecular weight: 379.49 White powder Melting point: 240° C. 1-NMR (in DMSO-d6): δ 3.15 (s,12H), 7.1–8.1 (m, 8Har)

Example 2

One part of the ditetramethylammonium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | +3 |
| 30 min | +2 |
| 2 hours | +1 |
| 24 hours | −3 |

Synthesis and Characterization

The procedure is as in Example 1 except that 72.9 g of a 25 % strength aqueous tetramethylammonium hydroxide solution (0.20 mol) are added.

Yield: 45.2 (sic) (99.9% of theory) of the di(tetramethylammonium) salt of 2,2'-dithiodibenzoic acid, of the formula

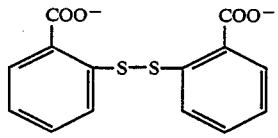

Di-tetrabutylammonium (sic)

$C_{22}H_{32}N_2O_4S_2$, molecular weight: 452.63 White powder Melting point: 252° C. 1H-NMR (in DMSO-d6): δ 3.17 (s, 24H), 6.9–7.9 (m, 8Har)

Example 3

One part of the monotetraethylammonium salt of 2,2'-DTDB (see below for synthesis and characterization) was incorporated in 99 parts of Dialec 309 as described in Example 1. The following q/m values were measured, depending on the activation time:

| Activation time | The following q/m values are found at modified atmospheric humidity: | | |
|---|---|---|---|
| | [μC/g] | 20% [μC/g] | 90% [μC/g] |
| 10 min | +9 | +10 | +3 |
| 30 min | +7 | +7 | +3 |
| 2 hours | +6 | +4 | +3 |
| 24 hours | +1 | +2 | +3 |

Synthesis and Characterization

The procedure is as in Example 1 except that 36.8 g of a 40% strength aqueous tetraethylammonium hydroxide solution (0.10 mol) are used in place of tetramethylammonium hydroxide solution.

Yield: 43.3 g (99.4% of theory) Mono(tetraethylammonium) salt of 2,2'-dithiodibenzoic acid, of the formula

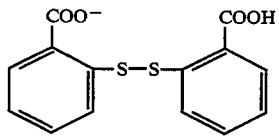

-continued

Tetraethylammonium $C_{22}H_{29}NO_4S_2$, molecular weight 435.60 White powder Melting point: 255° C. 1H-NMR (in DMSO-d6): δ 1.15 (t,12H), 3.20 (q,8H), 7.1–8.1 (m,8Har)

Example 4

One part of the ditetramethylammonium salt of 2,2'-DTDB (see below for synthesis and characterization) was incorporated in 99 parts of Dialec S 309 as described in Example 1. The following q/m values were measured depending on the activation time:

| Activation time | [μC/g] |
|---|---|
| 10 min | +5 |
| 30 min | +4 |
| 2 hours | +2 |
| 24 hours | +0 |

Synthesis and Characterization

The procedure is as in Example 1 except that 73.6 g of a 40% strength aqueous tetraethylammonium hydroxide solution (0.20 mol) are used in place of tetramethylammonium hydroxide solution.

Yield: 56.3 g (99.7% of theory) Di(tetraethylammonium) salt of 2,2'-dithiodibenzoic acid, of the formula

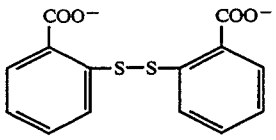

Di-tetraethylammonium $C_{30}H_{48}N_2O_4S_4$, molecular weight 564.84 White powder Melting point: 160° C. 1H-NMR (in DMSO-d6): δ 1.10 (t, 24H), 3.15 (q, 16H), 6.8–7.9 (m, 8Har).

Example 5

One part of the monotetrapropylammoniumsalt of 2,2'-DTDB (see below for synthesis and characterization) was incorporated in 99 parts of Dialec S 309 as described in Example 1. The following q/m values were measured, depending on the activation time:

| Activation time | The following q/m values are found at modified atmospheric humidity: | | |
|---|---|---|---|
| | [μC/g] | 20% [μC/g] | 90% [μC/g] |
| 10 min | +11 | +10 | +12 |
| 30 min | +12 | +7 | +11 |
| 2 hours | +10 | +4 | +10 |
| 24 hours | +7 | +2 | +5 |

The following q/m values were measured when 2 parts of the salt were incorporated in 98 parts of Dialec S 309:

| Activation time | [μC/g] |
|---|---|
| 10 min | +15 |
| 30 min | +15 |
| 2 hours | +13 |

-continued

| Activation time | [μC/g] |
|---|---|
| 24 hours | +8 |

The procedure is as in Example 1 except that 101.7 g of a 20% strength aqueous tetraproprylammonium hydroxide solution (0.10 mol) are used in place of tetramethylammonium hydroxide solution.

Yield: 48.7 g (99.0% of theory) Mono(tetrapropylammonium) salt of 2,2'-dithiodibenzoic acid, of the formula

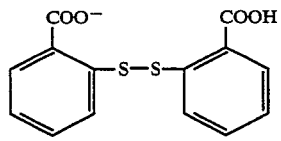

Tetrapropylammonium $C_{26}H_{37}NO_4S_2$, molecular weight 491.70 White powder Melting point: 255° C. 1H-NMR (in DMSO-d6): δ 0.90 (t, 12H), 1.60 (m, 8H), 3.10 (m, 8H), 7.1–8.1 (m, 8H).

Example 6

One part of the monotetrapropylammonium salt of 2,2'-DTDB, which was prepared by the precipitation method instead of by the neutralization reaction (see below for synthesis and characterization) was incorporated in 99 (sic) Dialec S 309 as described in Example 1. The following qm values were measured, depending on the activation time.

| Activation time | [μC/g] |
|---|---|
| 10 min | +10 |
| 30 min | +10 |
| 2 hours | +9 |
| 24 hours | +8 |

Synthesis and Characterization 30.6 g of 2,2'-dithiodibenzoic acid (0.10 mol) are introduced into a solution of 8.00 g of sodium hydroxide (0.20 mol) in 800 ml of water at room temperature, with stirring, and dissolved. A solution of 26.6 g of tetrapropylammonium bromide (0.10 mol) in 300 ml of water is added to this solution. A solution of 3.65 g of hydrogen chloride (0.10 mol) in 100 ml of water is then added slowly dropwise, the product precipitating out. The reaction mixture is stirred for a further 15 hours. The precipitate is then filtered off with suction, washed with water and dried in a circulating air oven at 120° C.

Yield: 46.1 g (93.8% of theory) Mono(tetrapropylammonium) salt of 2,2'-dithiodibenzoic acid, of the formula given in Example 5. White powder Melting point: 255° C. 1H-NMR (in DMSO-d6): in agreement with the spectrum of the product of Example 5.

Example 7

1 part of the monotetrabutylammonium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | +20 |
| 30 min | +20 |
| 2 hours | +19 |
| 24 hours | +16 |

The following q/m values were obtained when 0.5 part of the salt was incorporated in 99.5 parts of Dialec S 309.

| Activation time | [μC/g] |
|---|---|
| 10 min | +13 |
| 30 min | +18 |
| 2 hours | +18 |
| 24 hours | +17 |

Synthesis and Characterization

The procedure is as in Example 1 except that 65 g of a 40% strength aqueous tetrabutylammonium hydroxide solution (0.10 mol) are used in place of tetramethylammonium hydroxide solution.

Yield: 54.3 g (99.1% of theory) Mono(tetrabutylammonium) salt of 2,2'-dithiodibenzoic acid, of the formula

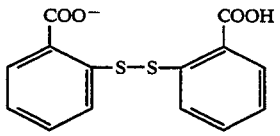

Tetrabutylammonium $C_{30}H_{45}NO_4S_2$, molecular weight 547.81 White powder Melting point: 228° C. 1H-NMR (in DMSO-d6): δ 0.91 (t, 12H), 1.30 (m, 8H), 1.58 (m, 8H), 3.18 (m, 8H), 7.1–8.1 (m, 8Har).

Example 8

One part of the monotetramethylguanidinium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | −7 |
| 30 min | −10 |
| 2 hours | −12 |
| 24 hours | −12 |

Synthesis and Characterization 30.6 g of 2,2'-dithiodibenzoic acid (0.10 mol) are suspended in 600 ml of methanol. A solution of 11.5 g of 1,1,3,3-tetramethylguanidine (0.10 mol) in 35 ml of water is added slowly dropwise to this suspension at about 65° C., with stirring.

After concentrating, the reaction solution is dried in a circulating air oven at 120° C. The product is then ground.

Yield: 41.7 g (99.0% of theory) Mono(1,1,3,3-tetramethylguanidinium) salt of the 2,2'-dithiodibenzoic acid, of the formula

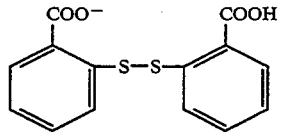

1,1,3,3-tetramethylguanidinium $C_{19}H_{23}N_3O_4S_2$, molecular weight: 421.53 White powder Melting point: 205° C. 1H-NMR (DMSO-d6): δ 2.9 (s,12H), 7.1–8.0 (m,8Har), 8.1 (s,2H)

Example 9

One part of the ditetrabutylammonium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | +25 |
| 30 min | +22 |
| 2 hours | +20 |
| 24 hours | +15 |

Synthesis and Characterization

The procedure is as in Example 1 except that 130 g of a 40% strength aqueous tetrabutylammonium hydroxide solution (0.20 mol) are used in place of tetramethylammonium hydroxide solution.

Yield: 87.5 g (99.8% of theory) of 90% pure di(tetrabutylammonium) salt of 2,2'-dithiodibenzoic acid, of the formula

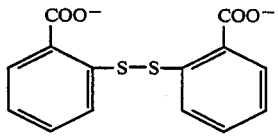

Di-tetrabutylammonium $C_{46}H_8ON_2O_4S_2$, molecular weight 789.27, viscous oil, after prolonged standing in air waxy mass containing 10% by mass of water, melting point approx. 45° C. 1H-NMR (in DMSO-d6): δ 0.92 (t, 24H), 1.30 (m, 16H), 1.58 (m, 16H), 3.19 (m, 16H), 6.95–7.85 (m, 8Har).

Example 10

One part of the monotetrabutylphosphonium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | +8 |
| 30 min | +5 |
| 2 hours | +3 |
| 24 hours | +3 |

Synthesis and Characterization

The procedure is as in Example 8 except that 33.9 g of tetrabutylphosphonium bromide (0.10 mol) are used in place of tetrapropylammonium bromide.

Yield: 50.9 g (90.1% of theory) Mono(tetrabutylphosphonium) salt of 2,2'-dithiodibenzoic acid, of the formula

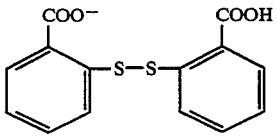

Tetrabutylphosphonium $C_{30}H_{45}O_4PS_2$, molecular weight: 564.78 White powder Melting point: 243° C. 1H-NMR (in DMSO-d6): δ 0.95 (t, 12H), 1.44 (m, 16H), 2.20 (m, 8H), 7.15–8.05 (m, 8Har).

Example 11

One part of the monotributylmethylammonium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | +1 |
| 30 min | −1 |
| 2 hours | −5 |
| 25 hours | −9 |

Synthesis and Characterization

The procedure is as in Example 1 except that 54.4 g of a 40% strength aqueous tributylmethylammonium hydroxide solution (0.10 mol) are used in place of tetramethylammonium hydroxide solution.

Yield: 50.3 g (99.5% of theory) Mono(tributylmethylammonium) salt of 2,2'-dithiodibenzoic acid, of the formula

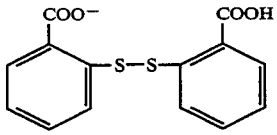

Tributylmethylammonium $C_{27}H_{39}NO_4S_2$, molecular weight: 505.73 White powder Melting point: 198° C. 1H-NMR (in DMSO-d6): δ 0.90 (t, 9H), 1.28 (m, 6H), 1.59 (m, 6H), 2.96 (s, 3H), 3.20 (m, 6H), 7.1–8.1 (m, 8Har).

Example 12

One part of the monotrimethylbenzylammoniumsalt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | +21 |
| 30 min | +21 |
| 2 hours | +16 |
| 24 hours | +8 |

Synthesis and Characterization

The procedure is as in Example 1, except that 47.7 g of a 35% strength methanolic benzyltrimethylammonium hydroxide solution (0.10 mol) are used in place of tetramethylammonium hydroxide solution.

Yield: 45.4 g (99.6% of theory) Monobenzyltrimethylammonium) salt of 2,2'-dithiodibenzoic acid, of the formula

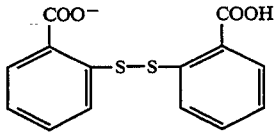

Benzyltrimethylammonium $C_{24}H_{25}NO_4S_2$, molecular weight: 455.59 White powder Melting point: 164° C. 1H-NMR (in DMSO-d6): δ 3.07 (s, 9H), 4.59 (s, 2H), 7.1–8.1 (m, 13Har 9. (sic)

Example 13

1 part of the barium salt of 2,2'-DTDB (see below for synthesis and characterization) was incorporated in 99 parts of Dialec S 309 as described in Example 1. The following q/m values were measured, depending on the activation time:

| Activation time | [μC/g] |
|---|---|
| 10 min | −1 |
| 30 min | −6 |
| 2 hours | −11 |
| 24 hours | −16 |

Synthesis and Characterization 30.6 g of 2,2-dithiobibenzoic (sic) acid (0.10 mol) are introduced into a solution of 8.00 g of sodium hydroxide (0.20 mol) in 350 ml of water at room temperature, with stirring, and dissolved. A solution of 24.5 g of barium chloride dihydrate (0.10 mol) in 70 ml of water is added to this solution. The reaction mixture is stirred for a further 15 hours at room temperature, the product precipitating out. The reaction mixture is then placed in a refrigerator for a further 24 hours at +4° C. and the precipitate is filtered off with suction, washed with cold water and dried in a circulating air oven at 120° C.

Yield: 36.5 g (82.6% of theory) Barium salt of 2,2'-dithiodibenzoic acid, of the formula

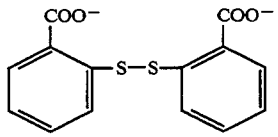

Barium++

$C_{14}H_8BaO_4S_2$, molecular weight 441.67 White powder Melting point: 330° C. IR (KBr): 1587, 1570, 1535, 1384, 1277, 1036, 840, 742 and 705 $cm^{-1}$.

Example 14

One part of 2,2'-DTDB was incorporated in 99 parts of Dialec S 309 as described in Example 1. The following q/m values were measured, depending on the activation time:

| Activation time | [μC/g] |
|---|---|
| 10 min | −8 |
| 30 min | −13 |
| 2 hours | −18 |

-continued

| Activation time | [μC/g] |
|---|---|
| 24 hours | −24 |

Example 15

One part of 4,4'-dithiodibenzoic acid was incorporated in 99 parts of Dialec S 309 as described in Example 1. The following q/m values were measured, depending on the activation time:

| Activation time | [μC/g] |
|---|---|
| 10 min | −1 |
| 30 min | −2 |
| 2 hours | −2 |
| 24 hours | +10 |

Example 16

One part of the monotetramethylammonium salt of 4,4'-sulfonyldibenzoic acid (see below for synthesis and characterization) was incorporated in 99 parts of Dialec S 309 as described in Example 1. The following q/m values were measured, depending on the activation time:

| Activation time | [μC/g] |
|---|---|
| 10 min | −2 |
| 30 min | −2 |
| 2 hours | −1 |
| 24 hours | −13 |

Synthesis and Characterization

The procedure is wir (sic) in Example 1, except that 30.6 g of 4,4'-sulfonyldibenzoic acid (0.10 mol) are used in place of 2,2'-dithiodibenzoic acid and 65 g of a 40% strength aqueous tetrabutylammonium hydroxide solution (0.10 mol) are used in place of tetramethylammonium hydroxide solution.

Yield: 54.3 g (99.1% of theory) Mono(tetrabutylammonium) salt of 4,4 '-sulfonyldibenzoic acid, of the formula

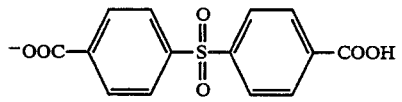

Tetrabutylammonium $C_{30}H_{45}NO_6S$, molecular weight: 547.75 White powder Melting point: 188° C. 1H-NMR (in DMSO-d6): δ 0.90 (t, 12H), 1.30 (m, 8H), 1.55 (m, 8H), 3.15 (m, 8H), 7.8–8.2 (2d 8Har).

Comparison Example 100 parts of the toner binder Dialec S 309 described in Example 1 were kneaded without further additives for 30 min in a kneader, as described in Example 1, and then ground, classified and measured on a q/m measuring stage.

The following q/m values were determined, depending on the activation time:

| Activation time | [μC/g] |
|---|---|
| 10 min | −4 |
| 30 min | −12 |
| 2 hours | −27 |
| 24 hours | −48 |

Example 17

One part of the monotetrabutylammonium salt of 2,2'-DTDB mentioned in Example 7 was incorporated together with 10 parts of Tiona RCL 628 (TiO2 (sic) from SCM, England), as described in Example 1, in 69 parts of Crylcoat 430 (carboxyl group-containing polyester resin from UCB, Belgium). The following q/m values were measured, depending on the activation time:

| Activation time | [μC/g] |
|---|---|
| 10 min | −6 |
| 30 min | −6 |
| 2 hours | −5 |
| 24 hours | −4 |

Example 18

One part of the monotetrabutylammonium salt of 2,2'-DTDB mentioned in Example 7 was incorporated in 99 parts of Crylcoat 430 as described in Example 1. The following q/m values were measured, depending on the activation time:

| Activation time | [μC/g] |
|---|---|
| 10 min | −7 |
| 30 min | −6 |
| 2 hours | −5 |
| 24 hours | −4 |

Comparison Example 100 parts of the polyester resin Crylcoat 430 were kneaded without further additive, ground, classified and then measured, as described in Example 1.

The following q/m values were determined, depending on the activation time:

| Activation time | [μC/g] |
|---|---|
| 10 min | −20 |
| 30 min | −15 |
| 2 hours | −8 |
| 24 hours | −4 |

Example 19

One part of the monotetrapropylammonium salt of 2,2'-DTDB mentioned in Example 5 was incorporated, as described in Example 1, in 99 parts of Atlac T 500 (polyester resin based on bisphenol A fumarate, Atlas Chemicals, Belgium). The following q/m values were measured, depending on the activation time:

| Activation time | [μC/g] |
|---|---|
| 10 min | −1 |
| 30 min | −1 |
| 2 hours | −0.5 |

-continued

| Activation time | [μC/g] |
|---|---|
| 24 hours | +2 |

Comparison Example 100 parts of the binder Atlac T 500 described in Example 19 were kneaded without further additives for 30 min in a kneader, then ground, classified and measured on a q/m measuring stage, as described in Example 1. The following q/m values [μC/g] were measured, depending on the activation time:

| Activation time | [μC/g] |
|---|---|
| 10 min | −28 |
| 30 min | −27 |
| 2 hours | −23 |
| 24 hours | −14 |

Example 20

0.5 part of the monotetrapropylammonium salt of 2,2'-DTDB used in Example 5 are incorporated homogeneously, as described in Example 1, in 99.5 parts of a powder coating binder ($^{R}$Alftalat AN 757 from Hoechst AG, polyester resin). The following q/m values [μC/g] were measured, depending on the activation time:

| Activation time | [μC/g] |
|---|---|
| 10 min | −21 |
| 30 min | −20 |
| 2 hours | −13 |
| 24 hours | −6 |

Comparison Example 100 parts of the powder coating binder Alftalat AN 757 described in Example 20 were kneaded without further additives for 30 min in a kneader and then ground, classified and measured on a q/m measuring stage, as described in Example 1. The following q/m values [μC/g] were measured, depending on the activation time:

| Activation time | [μC/g] |
|---|---|
| 10 min | −35 |
| 30 min | −32 |
| 2 hours | −24 |
| 24 hours | −13 |

We claim:

1. A method for regulating or improving the electrostatic charge properties of an electrophotographic toner or developer or a triboelectrically or electrokinetically applied powder or powder coating composition, comprising the step of incorporating into said toner or developer or powder or powder coating an aryl or aralkyl sulfide, sulfoxide or sulfone charge regulator or improver of the general formula (1)

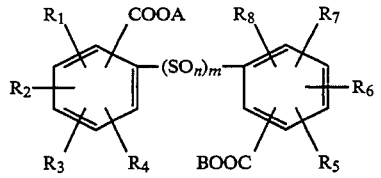

(1)

as a single compound of said formula (1) or as a combination of said compounds where, in formula (1), m is 1, 2 or 3, and n is 0, 1 or 2, and where A and B independently of one another are hydrogen atoms, the corresponding equivalents of a metal ion, and also an ammonium or immonium or guanidinium ion of the general formula

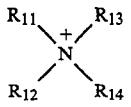

(2)

or

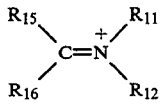

(3)

or a phosphonium, arsonium or stibonium ion of the general formula

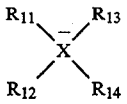

where X is P, As or Sb, in which $R_{11}$, $R_{12}$, $R_{13}$ and $R_{14}$ independently of one another are hydrogen atoms or radicals based on a hydrocarbon which can be interrupted by heteroatoms, and $R_{15}$ and $R_{16}$ independently of one another are hydrogen atoms, a halogen atom, alkoxy, —$NH_2$, primary or secondary amino groups or radicals based on a hydrocarbon, and where $R_1$ to $R_8$, independently of one another are each a hydrogen atom or a radical based on a hydrocarbon, which can be interrupted by heteroatoms, or halogen atoms, or alkoxy, nitro, cyano, sulfone, sulfonic acid ester, carboxylic acid ester, hydroxyl or $NR_{21}R_{22}$ group, in which $R_{21}$ and $R_{22}$ independently of one another are hydrogen atoms or radicals based on a hydrocarbon, it being possible for two of the radicals $R_1$ to $R_4$, or $R_5$ to $R_8$, or $R_{11}$ and $R_{13}$, or $R_{11}$ and $R_{15}$ independently of one another to join together to form a ring system, and it being possible for the compounds also to be present in the form of mixed crystals based on different anions and/or cations.

2. A composition as claimed in claim 1, wherein said composition comprises a charge-regulated toner binder.

3. A composition as claimed in claim 2, wherein said toner binder comprises styrene acrylate, polyester, epoxide, or polyurethane resin.

4. A composition as claimed in claim 2, wherein the concentration of charge regulator or improver or combination of charge regulators or improvers ranges from about 0.1 to about 5 percent by weight.

5. A composition as claimed in claim 1, wherein the formula (1) $R_1$ to $R_8$ independently of one another are hydrogen atoms, straight-chain or branched, saturated or unsaturated alkyl groups having 1 to 30 carbon atoms, -alkoxylene groups, polyalkoxylene groups of the general formula —n—R, in which R is a hydrogen atom or a ($C_1$-$C_4$)-alkyl or acyl group and n is a number from 1 to 10, and also mononuclear or polynuclear cycloaliphatic radicals of 5 to 12 carbon atoms, or mononuclear or polynuclear aromatic or araliphatic radicals, or are fluorine, chlorine or bromine atoms or a nitro, cyano, sulfone, sulfonic acid ester, carboxylic acid ester, hydroxyl or $NR_{21}R_{22}$ groups (sic), in which $R_{21}$ and $R_{22}$ independently of one another are a H atom or ($C_1$–$C_4$)-alkyl groups, it being possible for the said aliphatic, cycloaliphatic, araliphatic or aromatic radicals to be substituted by carboxylic acid groups or sulfonic acid groups, the salts or amides or esters thereof, or ($C_1$–$C_4$)-alkyl, hydroxyl, ($C_1$–$C_4$)-alkoxy groups, or primary, secondary or tertiary amino groups and also by fluorine, chlorine or bromine atoms and it being possible for the said aliphatic radicals and the cycloaliphatic, araliphatic or aromatic ring systems to contain one or more heteroatoms and it being possible for two of the radicals $R_1$ to $R_4$, or $R_5$ to $R_8$, independently of one another to join together to form a saturated or unsaturated 5-membered to 7-membered ring system, which can contain further heteroatoms and can be substituted and/or modified by addition by condensation of, or bridging to, further ring systems.

6. A composition as claimed in claim 1, wherein the formula (a) A and B independently of one another are hydrogen atoms, the corresponding equivalents of a calcium, magnesium, barium, aluminum, chromium, manganese, iron, cobalt, nickel, copper or zinc ion, or ammonium or immonium ions of the general formulae

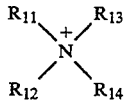

or

-continued

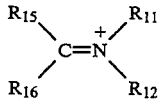

or phosphonium ions of the general formula

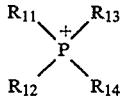

in which $R_{11}$, $R_{12}$, $R_{13}$ and $R_{14}$ independently of one another are hydrogen atoms, straight-chain or branched alkyl groups of 1 to 30 carbon atoms, oxyethyl groups of the general formula —($CH_2$—$CH_2$—O)n—R in which R is a hydrogen atom or a ($C_1$–$C_4$)-alkyl or acyl group, and n is a number from 1 to 10, and also mononuclear or polynuclear cycloaliphatic radicals of 5 to 12 carbon atoms, or mononuclear or polynuclear aromatic or araliphatic radicals, it being possible for the aliphatic, araliphatic and aromatic radicals to be substituted by hydroxyl, ($C_1$–$C_4$)-alkyl or ($C_1$–$C_4$)-alkoxy groups or primary, secondary or tertiary amino groups, and also by acid amide groups, as well as by fluorine, chlorine or bromine atoms, and $R_{15}$ and $R_{16}$, independently of one another, are hydrogen, fluorine, chlorine or bromine atoms or ($C_1$–$C_6$)-alkyl, ($C_1$–$C_6$)-alkoxy, —$NH_2$ or primary or secondary amino groups, it being possible for $R_{11}$ and $R_{13}$, or $R_{11}$ and $R_{15}$, to join together to form a saturated or unsaturated, substituted or unsubstituted ring system having 5 to 7 atoms, which can contain further heteroatoms.

7. A composition as claimed in claim 1, wherein in the formula (1), if m is 1, n is 1 or 2, and if m is 2 or 3, n is 0.

8. A composition as claimed in claim 1, wherein in the formula (1) the substituents —COOA and —COOB are in the 2,2′-position or 4,4(sic)-position relative to one another.

* * * * *

UNITED STATES PATENT AND TRADEMARK OFFICE

CERTIFICATE OF CORRECTION

PATENT NO. : 5,378,571

DATED : January 3, 1995

INVENTOR(S) : Hans-Tobias Macholdt et al

It is certified that error appears in the above-indentified patent and that said Letters Patent is hereby corrected as shown below:

Column 15, claim 1 should read as follows:

– 1. A toner or developer or powder coating composition comprising:

a synthetic organic resin having toner binder properties or properties suitable for use in a developer or properties suitable for triboelectric or electrokinetic spraying, and, incorporated therein in a concentration of form about 0.1 to about 30 percent by weight, a charge regulator or improver or combination of charger regulators or improvers of the general formula (1)

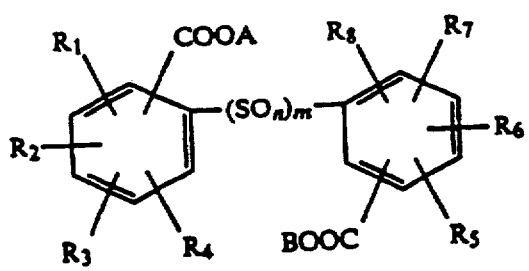

(1)

wherein, in formula (1), m is 1, 2 or 3, and n is 0, 1 or 2, and where A and B independently of one another are hydrogen atoms, the corresponding equivalents of a metal ion, or an ammonium, immonium, guanidinium, phosphonium, arsonium or stibonium ion, wherein $R_1$ to $R_8$, independently of each other are each a hydrogen atom or radical based on a hydrocarbon which can be interrupted heteroatoms, or halogen atoms, or alkoxy, nitro, cyano, sulphone, sulphonic acid ester, carboxylic acid ester, hydroxyl, or $NR_{21}R_{22}$ groups in which $R_{21}$ and $R_{22}$ independently of one another are hydrogen atoms or radicals based on a hydrocarbon, it further being possible for two of the radicals $R_1$ to $R_4$ or $R_5$ to $R_8$ independently of one another to join together to form a ring system.

UNITED STATES PATENT AND TRADEMARK OFFICE

CERTIFICATE OF CORRECTION

PATENT NO. : 5,378,571

DATED : January 3, 1995

INVENTOR(S) : Hans-Tobias Macholdt et al

It is certified that error appears in the above-indentified patent and that said Letters Patent is hereby corrected as shown below:

Columns 26 and 27, claim 5 should read as follows:

– 5. A composition as claimed in claim 1, wherein the formula (1) $R_1$ to $R_8$ independently of one another are hydrogen atoms, straight-chain or branched, saturated or unsaturated alkyl groups having 1 to 30 carbon atoms, $[C_1-C_4]$- alkoxylene groups, polyalkoxylene groups of the general formula -[($C_1$-$C_5$)alkylene-O]n-R, in which R is a hydrogen atom or a ($C_1$-$C_4$)-alkyl or acyl group and n is a number from 1 to 10, and also mononuclear or polynuclear cycloaliphatic radicals of 5 to 12 carbon atoms, or mononuclear or polynuclear aromatic or araliphatic radicals, or are fluorine, chlorine or bromine atoms or a nitro, cyano, sulfone, sulfonic acid ester, carboxylic acid ester, hydroxyl or $NR_{21}R_{22}$ groups (sic), in which $R_{21}$ and $R_{22}$ independently of one another are a H atom or ($C_1$-$C_4$)-alkyl groups, it being possible for the said aliphatic, cycloaliphatic, araliphatic or aromatic radicals to be substituted by carboxylic acid groups or sulfonic acid groups, the salts or amides or esters thereof, or ($C_1$-$C_4$)-alkyl, hydroxyl, ($C_1$-$C_4$)-alkoxy groups, or primary, secondary or tertiary amino groups and also by fluorine,

UNITED STATES PATENT AND TRADEMARK OFFICE

CERTIFICATE OF CORRECTION

PATENT NO. : 5,378,571

DATED : January 3, 1995

INVENTOR(S) : Hans-Tobias Macholdt et al

It is certified that error appears in the above-indentified patent and that said Letters Patent is hereby corrected as shown below:

chlorine or bromine atoms and it being possible for the said aliphatic radicals and the cycloaliphatic, araliphatic or aromatic ring systems to contain one or more heteroatoms and it being possible for two of the radicals $R_1$ to $R_4$, or $R_5$ to $R_8$, independently of one another to join together to form a saturated or unsaturated 5-membered to 7-membered ring system, which can contain further heteroatoms and can be substituted and/or modified by addition by condensation of, or bridging to, further ring systems. –

Signed and Sealed this

Twenty-third Day of May, 1995

*Attest:*

Bruce Lehman

BRUCE LEHMAN

*Attesting Officer*

*Commissioner of Patents and Trademarks*